US005706841A

United States Patent [19]

Werre et al.

[11] Patent Number: 5,706,841

[45] Date of Patent: Jan. 13, 1998

[54] ARRANGEMENT FOR CLEANING AUTOMATICALLY HEAT-EXCHANGING PASSAGEWAYS, PARTICULARLY TOOL-COOLANT PASSAGEWAYS

[75] Inventors: Lars Werre, Olaus Magnus Väg 8, S-121 40 Johanneshov; Johan Adler, Stockholm, both of Sweden

[73] Assignee: Lars Werre, Johanneshov, Sweden

[21] Appl. No.: 464,860

[22] PCT Filed: Jan. 13, 1994

[86] PCT No.: PCT/SE94/00018

§ 371 Date: Jul. 11, 1995

§ 102(e) Date: Jul. 11, 1995

[87] PCT Pub. No.: WO94/16280

PCT Pub. Date: Jul. 21, 1994

[30] Foreign Application Priority Data

Jan. 13, 1993 [SE] Sweden ..... 9300075

[51] Int. Cl.[6] ..... B08B 3/04

[52] U.S. Cl. ..... 134/56 R; 134/95.1; 134/98.1; 134/99.1; 134/113; 134/169 C; 134/95.2; 134/103.1; 137/637

[58] Field of Search ..... 134/169 C, 56 R, 134/169 A, 57 R, 169 R, 95.1, 95.2, 98.1, 99.2, 103.1, 99.1, 113; 137/565, 627.5, 637, 605

[56] References Cited

U.S. PATENT DOCUMENTS

| | | | |
|---|---|---|---|
| 614,625 | 11/1898 | Saunders . | |
| 2,893,407 | 7/1959 | Babson | 134/95.1 |
| 3,119,400 | 1/1964 | Bihler | 134/169 C |
| 3,536,081 | 10/1970 | Riess | 134/103.1 |
| 4,086,930 | 5/1978 | Hiss | 134/169 A |
| 4,127,160 | 11/1978 | Joffe | 134/169 A |
| 4,763,678 | 8/1988 | Ott | 134/169 C |
| 4,793,403 | 12/1988 | Vataru et al. | 165/95 |
| 4,832,752 | 5/1989 | Nezworski | 134/169 C |
| 4,917,123 | 4/1990 | McConnell et al. | 134/95.2 |
| 5,063,949 | 11/1991 | Yates | 134/98.1 |

FOREIGN PATENT DOCUMENTS

| | | |
|---|---|---|
| 0499139 | 8/1992 | European Pat. Off. . |
| 1517727 | 3/1968 | France . |
| 822320 | 1/1952 | Germany . |
| 2094927 | 9/1982 | United Kingdom . |

OTHER PUBLICATIONS

Patent Abstracts of Japan, vol. 9, No. 124, M–383, abstract of JP A 60–9711, Haruhisha Ikezoe, 18 Jan. 1985, Washing Method of Cooling Water Circuit of Mold or Molding Machine.

*Primary Examiner*—Frankie L. Stinson
*Attorney, Agent, or Firm*—Alfred J. Mangels

[57] ABSTRACT

The present invention relates to an arrangement for automatically cleaning heat-exchanging passageways, particularly the coolant passageways of tools. According to the invention, the arrangement includes an outlet line (1), an inlet line (2) and connections for connecting the outlet line and the inlet line to a respective inlet and outlet of the passageway or passageways to be cleaned; a liquid tank (3); a pump and associated lines (4, 6, 7) for filling the tank with cleaning liquid or with rinsing liquid; a pump and associated lines (6, 1, 2, 3, 5) for circulating liquid from the tank in a closed circuit through the passageway or passageways to be cleaned; and a microprocessor for performing automatically the operations of filling the tank with cleaning liquid, circulating cleaning liquid through the heat-exchanging passageway or passageways, emptying the tank of cleaning liquid, filling the tank with rinsing liquid and circulating the rinsing liquid in the heat-exchanging passageway or passageways, and emptying the tank and the heat-exchanging passageway or passageways of rinsing liquid.

8 Claims, 2 Drawing Sheets

ARRANGEMENT FOR CLEANING AUTOMATICALLY HEAT-EXCHANGING PASSAGEWAYS, PARTICULARLY TOOL-COOLANT PASSAGEWAYS

BACKGROUND OF THE INVENTION

1. Field of the Invention

The present invention relates to an arrangement for cleaning automatically heat-exchanging passageways, particularly tool-coolant passageways and more particularly coolant passageways of mould tools.

2. Description of the Related Art

In plastic injection molding processes, molten plastic material is injected into the cavity of a mold under high pressure and allowed to set in the mold. It is particularly important that the plastic material sets in the mold under well-controlled conditions, so as to avoid deviations from specified measurement tolerances or to prevent the occurrence of stresses in the plastic object produced. The setting process is controlled by cooling the tool with water which flows through coolant passageways in the tool. The water is brought to a temperature which corresponds to a given temperature program in a separate temperature control unit and is circulated through the tool-coolant passageways. After use, the tool-coolant passageways are blown clean with compressed air and the tool is placed in storage until it is needed for use in the manufacture of a new series of the plastic objects concerned.

Corrosion of the coolant passageways during storage is unavoidable. The coolant passageways also become dirty during the actual cooling process, due to the fact that the coolant used is normally conventional mains water. Thus, the coolant passageways of a tool taken from the tool store will be coated with rust and impurities thereby making it necessary to modify the aforesaid temperature program in order to take into account the resultant changes in the dimensions of the passageways. After being used for some time, the aforesaid coatings will become so thick as to make it impossible to carry out the temperature program intended, owing to the fact that the cooling effect achieved is no longer sufficient for the purpose intended. It is then necessary to dismantle the tool and to remove the coatings on the coolant passageways mechanically. This mechanical treatment of the passageways also results in passageway dimensions which differ from the original dimensions, meaning that the cooling process must be calibrated prior to using the tool in production.

The present invention is intended to provide an arrangement which will enable heat-exchanging passageways to be cleaned automatically, such that the passageways will always have the same dimensions after being cleaned.

SUMMARY OF THE INVENTION

According to the invention, this is achieved with an arrangement of the aforedefined kind which is characterized in that the arrangement includes an outlet line and an inlet line; means for connecting the outlet line and the inlet line to a respective inlet and outlet of the passageway or passageways to be cleaned; means for filling a tank with cleaning liquid or with rinsing liquid; means for circulating liquid from the tank in a closed circuit through the passageway or passageways to be cleaned; and means for automatically effecting the operations of filling the tank with cleaning liquid, circulating the cleaning liquid through the heat-exchanging passageway or passageways, emptying the tank of cleaning liquid, filling the tank with rinsing liquid and circulating this liquid in the heat-exchanging passageway or passageways, and emptying the tank and the heat-exchanging passageway or passageways of rinsing liquid. Since the dimensions of the passageways are not changed by being cleaned, the same temperature program can be used repeatedly for one and the same mold tool in the manufacture of different series of a plastic object with produced objects having mutually the same quality. This results in a time saving in comparison with earlier methods and arrangements, since it is no longer necessary to adapt the temperature program due to deposits in the coolant passageways prior to manufacturing a series of plastic objects, and that a more uniform quality of manufactured objects will be achieved, because the setting process will be the same for the various series manufactured, which is difficult to achieve when the thickness of the coatings or deposits change from series to series.

BRIEF DESCRIPTION OF THE DRAWINGS

Exemplifying embodiments of the invention will now be described in more detail with reference to the accompanying drawings, in which.

DESCRIPTION OF THE PREFERRED EMBODIMENTS

Figure 1:
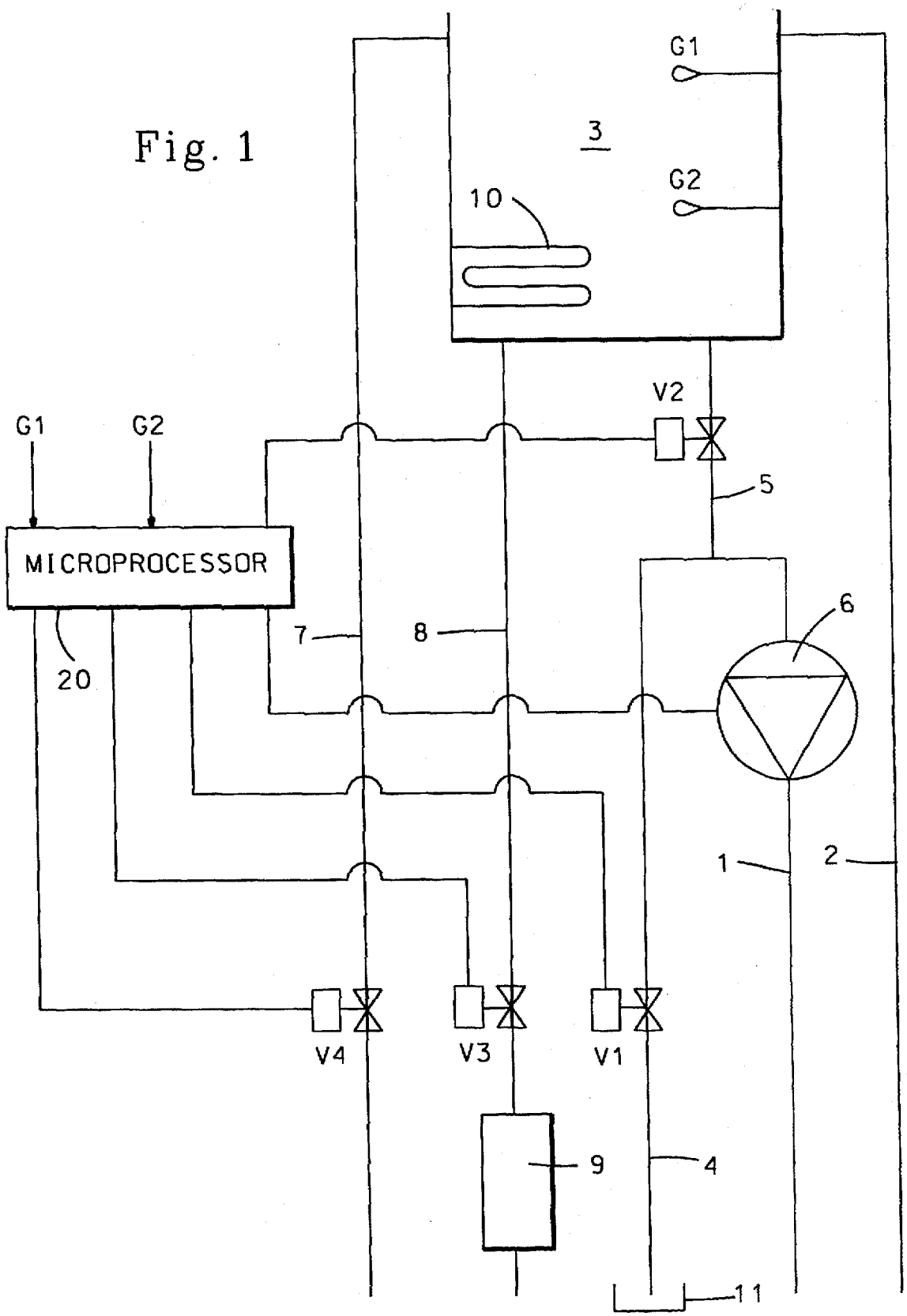
FIG. 1 illustrates schematically a first embodiment of an inventive arrangement.

The arrangement illustrated schematically in FIG. 1 includes an outlet line 1 which, although not shown, is fitted with quick-coupling means for connection to an inlet to the coolant passageway or passageways of a mold tool to be cleaned. The outlet from the coolant passageway or passageways of the tool can be connected to an inlet line 2, which extends to a liquid tank 3. The line 1 is connected to a line 4 which extends to a cleaning liquid container 11 and to the tank 3, via a line 5. The lines 4 and 5 can be connected by means of respective valves V1 and V2. The arrangement also includes a pump 6 which functions to circulate liquid through the tool passageways to be cleaned that are connected to the lines 1 and 2. A rinsing liquid supply line 7 opens into the tank 3, and a waste outlet line 8 provided with a pH filter 9, for instance a container filled with a pH neutralizing limestone, is arranged on the bottom of the tank. The lines 7 and 8 can be connected by means of respective valves V4 and V3. The arrangement also includes a heating coil or loop 10 arranged in the tank 3, and two level sensors G1 and G2 which are mounted at different levels in the tank 3. Finally, the arrangement includes a microprocessor 20 for controlling the various components of the arrangement.

The arrangement operates as follows:

In the starting mode of the arrangement, the valve V1 is open and the valves V2–V4 are closed. After having connected the outlet line i and the inlet line 2 to the inlet and the outlet respectively of the tool-coolant passageways to be cleaned, the pump 6 is started up. Cleaning liquid is therewith drawn from the container 11 and pumped through the lines 4 and 1 into the tool-coolant passageways and passes therethrough into the tank 3, via the inlet line 2.

When the tank 3 has been filled with cleaning liquid, the level sensor G1 produces a signal which causes the valve V1 to close, the valve V2 to open and the heating loop 10 to become operative. The cleaning liquid is then circulated in a closed circuit through the tool-coolant passageways, the line 2, the tank 3 and the lines 5 and 1.

The heating loop 10 is intended to maintain the cleaning liquid at a constant temperature, and is preferably thermostat controlled to this end. As the heated cleaning liquid circulates through the coolant passageways, existing deposits, coatings, dirt and rust are dissolved chemically.

After the cleaning liquid has been circulated for a length of time sufficient for all coatings on the walls of the coolant passageways to have been dissolved in the liquid, the valve V3 is opened and cleaning liquid containing dissolved dirt exits from the tank 3 through the outlet line 8. As the liquid is discharged from the tank, the remaining cleaning liquid in the tank is still circulated in the heating loop 10. When the level of liquid in the tank has fallen to the level of the sensor G2, the sensor produces a signal which causes the valve V4 to open. The rinsing liquid used in the described embodiment is pressurized mains water, and consequently when the valve V4 is open, the tank 3 begins to fill with water. It should be noted in this connection that the lines 7 and 8 are so dimensioned that the flow of water from the rinsing line 7 will be greater than the liquid outflow through the outlet line 8. When the level of liquid in the tank 3 reaches the level sensor G1, the sensor produces a signal which causes the valve V4 to close. The level of liquid in the tank will now again fall to the level of the sensor G2, whereupon the sensor again produces a signal which causes the valve V4 to open. This sequence is repeated for a predetermined number of times.

Upon completion of the rinsing operation, the valve V4 is held closed and the pump 6 is stopped, whereas the valve V3 is held open until the tank is completely empty. The valve V2 in the line 5 between the outlet line 1 and the tank 3 is closed at the same time as the pump is stopped. Finally, the outlet valve V3 is closed and the valve V1 in the rinsing liquid line 4 is opened, wherewith the arrangement is placed in its starting mode.

The inventive arrangement includes a microprocessor, which controls the arrangement components automatically.

The only manual work required is that which involves connecting the outlet and inlet lines of the arrangement to the respective inlet and outlet of the tool-coolant passageway or passageways to be cleaned, and that which involves pressing the arrangement starting button. When one and the same arrangement is intended to serve several different types of tool, it may also be necessary to indicate the type of tool concerned, for instance by turning a selector knob to a particular type of tool.

So that unavoidable rust will not change the dimensions of the coolant passageways, and therewith influence the reproducibility of the course taken by the setting process in mutually different manufactured series, the aforedescribed arrangement will preferably be used immediately prior to commencing manufacture, for instance by collecting the tool concerned from the tool store on the evening prior to manufacture and subjecting the tool to the automatic cleaning procedure afforded by the inventive arrangement, which may take up to six hours during the night preceding said manufacture.

Figure 2:
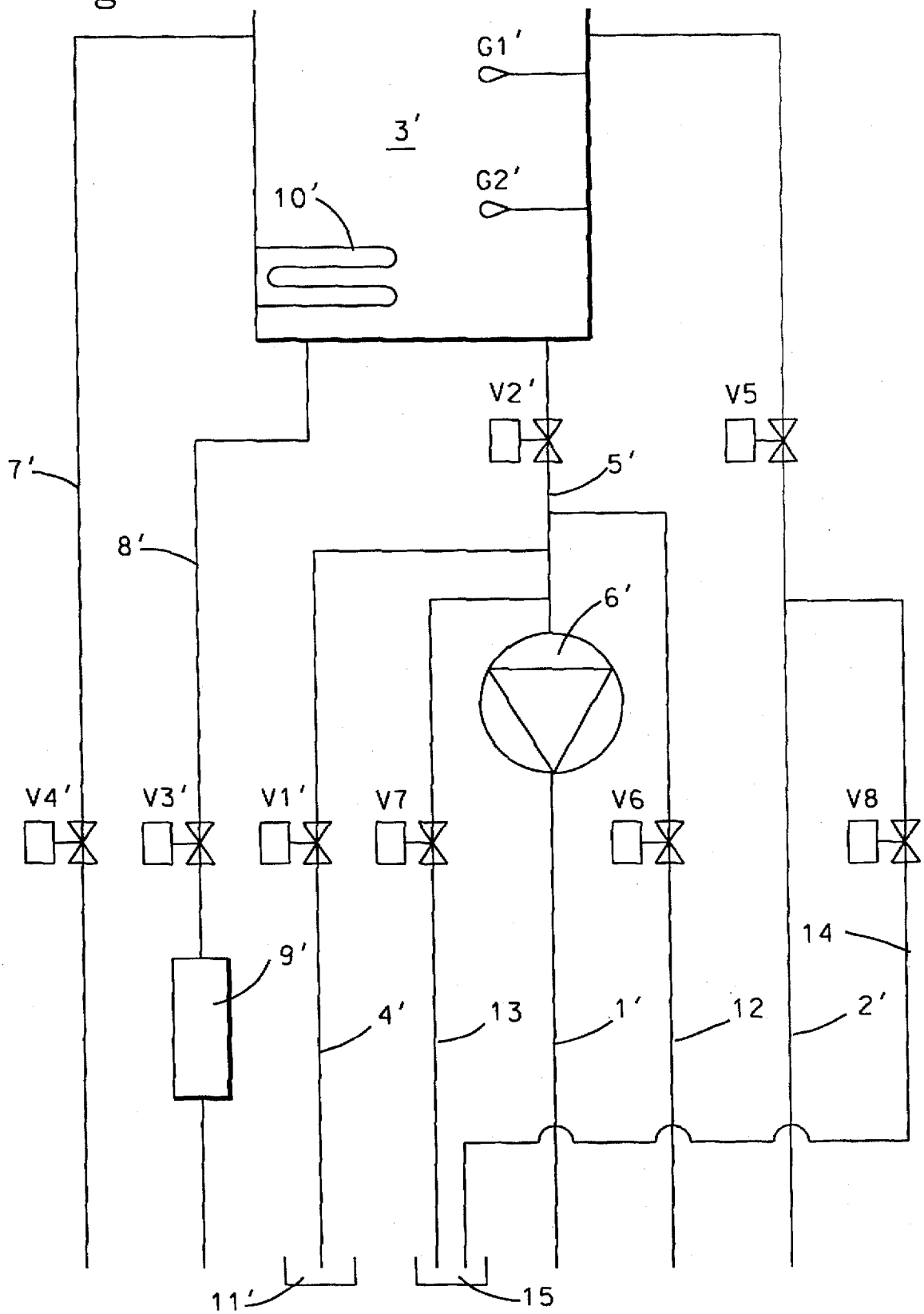
FIG. 2 illustrates schematically a second embodiment of an inventive arrangement.

FIG. 2 illustrates a second embodiment of an inventive arrangement. This arrangement has the same basic construction as the arrangement illustrated in FIG. 1 and similar components have been identified with the same reference signs used in the FIG. 1 illustration but with the addition of a prime. In addition to those components that are common to the arrangement shown in FIG. 1, the arrangement illustrated in FIG. 2 includes a compressed air line 12 and associated valve V6 connected to the suction side of the pump 6', a supply line which conducts corrosion-inhibiting liquid and includes a valve V7 also connected to the suction side of the pump 6', and a return line 14 for conducting corrosion-inhibiting liquid and including a valve V8 which is connected to the inlet line 2' of the arrangement, said return line 14 opening into the corrosion-inhibiting liquid container 15 from which the aforesaid supply line 13 extends to the suction side of the pump 6'. The arrangement also includes a valve V5 which is mounted in the inlet line 2' of the arrangement, between the tank 3' and the point at which the line 2' joins the line 14.

The arrangement illustrated in FIG. 2 operates in the same manner as the arrangement illustrated in FIG. 1, up to the point at which rinsing is terminated, the pump 6' has been stopped and the valve V2' has been closed. The valve V6 in the compressed air line 12 is then opened and the pump, coolant passageways and the lines 1', 2' are purged of rinsing liquid by means of the compressed air. The valve V6 is then closed and the valves V7 and V8 opened, whereas the valve V5 is closed. The pump 6' is restarted at the same time. As a result, corrosion-inhibiting liquid will be drawn by suction from the container 15 and flushed through the tool-coolant passageways connected to the outlet and inlet lines 1', 2' of the arrangement, and returned to the container 15 through the return line 14. After the corrosion-inhibiting liquid has been circulated through the coolant passageways for a given length of time, the pump 6' is again stopped and the valve V7 closed. The compressed air valve V6 is then opened briefly so as to blow excess corrosion-inhibiting liquid back to the container 15. Finally, the valve V1' is opened to return the arrangement to its starting mode upon completion of the cleaning process.

A tool that has been cleaned with the aid of the arrangement illustrated in FIG. 2 can be used immediately after being fetched from the tool store without risk of the reproducibility of the manufacturing process being influenced by the fact that the tool has been stored unused over a long period of time since its previous use.

It will be understood that the described and illustrated embodiments of the inventive arrangement can be modified within the scope of the invention. For instance, the rinsing liquid line can be connected in parallel with the cleaning liquid supply line when rinsing liquid other than mains water under pressure is to be used and the pump is used to deliver rinsing liquid. Furthermore, the arrangement may be provided with a container for collecting waste liquid when not wishing to discharge the waste liquid neutralized by the pH filter directly to the floor drain of the room in which the arrangement is installed. It is also conceivable for the arrangement to include a mixing vessel in which concentrated cleaning agent is diluted with mains supply water prior to circulating the cleaning liquid in the passageways to be cleaned. When the arrangement is to be used solely to carry out one or a few cleaning programs, it is, of course, possible to replace the microprocessor with other devices, for instance with a program mechanism of the kind used in washing machines.

Because the coolant passageways of a mold tool are cleaned very effectively by means of the inventive arrangement, one and the same temperature program can be used repeatedly for manufacturing different series of plastic objects, where the objects of the different series will have mutually the same quality because the course taken by the setting or curing process of the plastic will be identical from series to series. Because the coolant passageways are cleaned thoroughly, it is not necessary to recalibrate the temperature program of the tool each time the tool is to be used, as was earlier the case, and because cleaning of the tool is effected automatically and without the assistance of personnel, as opposed to the aforesaid calibration, the downtime in the manufacture of the plastic objects concerned will also be reduced.

Although the arrangement is primarily intended for cleaning the coolant passageways of a mold tool or several mold tools connected in series, it will be understood that the arrangement can also be used for cleaning heat-exchanging passageways of other objects, such as the passageways of small heat exchangers, for instance. The invention is therefore only restricted by the content of the following Claims.

We claim:

1. Apparatus for automatically cleaning heat-exchanging passageways, such as the coolant passageways of tools, said apparatus comprising: a liquid tank; conduit means for selectively filling the tank with one of a cleaning liquid and a rinsing liquid, the conduit means including an inlet line extending from the apparatus and adapted to be connected with one of an inlet for heat exchange fluid and an outlet for heat exchange fluid, and an outlet line extending from the apparatus and adapted to be connected with the other of the inlet for heat exchange fluid and the outlet for heat exchange fluid; means for circulating liquid from the tank in a closed circuit through a passageway to be cleaned; and control means for automatically controlling the operations of filling the tank with cleaning liquid, circulating cleaning liquid through the passageway to be cleaned and into the tank, emptying the tank of cleaning liquid, filling the tank with rinsing liquid and circulating said liquid in the passageway to be cleaned and into the tank, and emptying the rinsing liquid from the tank and the passageway to be cleaned, wherein two liquid level sensors are mounted at different levels in the tank in order to control the filling and emptying of the liquid tank.

2. Apparatus according to claim 1, including heating means mounted in the tank for heating liquid contained in the tank.

3. Apparatus according to claim 1, wherein the means for filling the tank with rinsing liquid includes a rinsing liquid supply line connected to a water supply line, and a flow control valve positioned in the rinsing liquid supply line.

4. Apparatus according to claim 1, wherein an outlet line from the tank includes a Ph filter.

5. Apparatus according to claim 1, wherein the means for circulating liquid from the tank includes a pump which functions to pump liquid from the tank in a closed circuit through the passageway to be cleaned that is connected to the apparatus.

6. Apparatus according to claim 5, wherein a compressed airline is connected to the suction side of the pump, and a flow control valve is positioned in the compressed air line.

7. Apparatus according to claim 6, including a container for corrosion-inhibiting liquid, wherein a line extending from the container is connected to the suction side of the pump, and wherein a return line that extends from the container is connected to the inlet line of the apparatus.

8. Apparatus according to claim 1, wherein the control means includes a microprocessor.

* * * * *